US007585426B2

(12) United States Patent
Collier et al.

(10) Patent No.: US 7,585,426 B2
(45) Date of Patent: Sep. 8, 2009

(54) COMPOSITIONS AND METHODS FOR IMPARTING STAIN RESISTANCE, LIQUID REPELLENCY, AND ENHANCED ANTIMICROBIAL ACTIVITY TO AN ARTICLE AND ARTICLES THEREOF

(75) Inventors: Robert B. Collier, Cohutta, GA (US); J. Todd Mull, Ringgold, GA (US)

(73) Assignee: ArrowStar, LLC, Dalton, GA (US)

( * ) Notice: Subject to any disclaimer, the term of this patent is extended or adjusted under 35 U.S.C. 154(b) by 0 days.

(21) Appl. No.: 11/084,924

(22) Filed: Mar. 21, 2005

(65) Prior Publication Data

US 2005/0210600 A1 Sep. 29, 2005

Related U.S. Application Data

(60) Provisional application No. 60/557,037, filed on Mar. 26, 2004.

(51) Int. Cl.
*D06M 11/83* (2006.01)

(52) U.S. Cl. ..... 252/8.62; 8/115.56

(58) Field of Classification Search ..... 8/115.51, 8/115.5, 115.6; 252/8.62
See application file for complete search history.

(56) References Cited

U.S. PATENT DOCUMENTS

| | | | | | |
|---|---|---|---|---|---|
| 3,560,385 | A | | 2/1971 | Roth | |
| 3,794,736 | A | | 2/1974 | Abbott | |
| 3,814,739 | A | | 6/1974 | Takeda | |
| 3,949,124 | A | | 4/1976 | Jilla | |
| 4,124,395 | A | * | 11/1978 | Ochiai et al. | 430/532 |
| 4,145,303 | A | * | 3/1979 | Loudas | 510/528 |
| 4,304,675 | A | | 12/1981 | Corey | |
| 4,437,429 | A | | 3/1984 | Goldstein et al. | |
| 4,566,980 | A | | 1/1986 | Smith | |
| 4,592,940 | A | | 6/1986 | Blyth | |
| 4,648,882 | A | | 3/1987 | Osberghaus | |
| 4,699,812 | A | | 10/1987 | Munk | |
| 4,775,588 | A | | 10/1988 | Ishii et al. | |
| 4,793,833 | A | | 12/1988 | Lok et al. | |
| 4,822,373 | A | | 4/1989 | Olson | |
| 4,839,212 | A | | 6/1989 | Blyth | |
| 4,937,123 | A | | 6/1990 | Chang et al. | |
| 4,940,757 | A | | 7/1990 | Moss | |
| 4,943,612 | A | * | 7/1990 | Morita et al. | 524/714 |
| 5,064,613 | A | | 11/1991 | Higgs | |
| 5,145,592 | A | | 9/1992 | Caporiccio | |
| 5,147,722 | A | | 9/1992 | Koslow | |
| 5,411,585 | A | | 5/1995 | Avery | |
| 5,539,015 | A | | 7/1996 | Horii | |
| 5,670,246 | A | * | 9/1997 | Pechhold et al. | 442/93 |
| 5,672,651 | A | * | 9/1997 | Smith | 524/590 |
| 5,683,976 | A | | 11/1997 | Colurciello | |
| 5,948,480 | A | | 9/1999 | Murphy | |
| 5,952,447 | A | | 9/1999 | Ikeda | |
| 5,959,014 | A | | 9/1999 | Liebeskind | |
| 6,040,044 | A | | 3/2000 | Takahashi | |
| 6,136,771 | A | * | 10/2000 | Taylor et al. | 510/388 |
| 6,221,944 | B1 | | 4/2001 | Liebeskind | |
| 6,274,129 | B1 | * | 8/2001 | Bhatt et al. | 424/70.11 |
| 6,284,232 | B1 | | 9/2001 | Calton et al. | |
| 6,387,448 | B1 | | 5/2002 | Collier | |
| 6,395,459 | B1 | * | 5/2002 | Taylor et al. | 430/434 |
| 6,534,150 | B1 | | 3/2003 | Yamanaka | |
| 6,613,862 | B2 | | 9/2003 | Clark et al. | |
| 6,635,702 | B1 | * | 10/2003 | Schmucker-Castner et al. | 524/291 |
| 6,669,816 | B1 | * | 12/2003 | Poch et al. | 162/164.1 |
| 6,846,846 | B2 | * | 1/2005 | Modak et al. | 514/722 |
| 2003/0216479 | A1 | * | 11/2003 | Huang et al. | 514/721 |

FOREIGN PATENT DOCUMENTS

| | | | |
|---|---|---|---|
| JP | 62184087 | * | 8/1987 |
| WO | WO99/67464 | * | 12/1999 |

* cited by examiner

*Primary Examiner*—Lorna M Douyon
*Assistant Examiner*—Amina Khan
(74) *Attorney, Agent, or Firm*—Gardner Groff Greenwald & Villanueva, PC

(57) ABSTRACT

Described herein are compositions and methods for imparting stain resistance, liquid repellency and enhanced antimicrobial activity to an article. The composition include a solvent, a surfactant, and an aluminum polymer. Also described herein are articles treated with the compositions and methods described herein.

19 Claims, No Drawings

COMPOSITIONS AND METHODS FOR IMPARTING STAIN RESISTANCE, LIQUID REPELLENCY, AND ENHANCED ANTIMICROBIAL ACTIVITY TO AN ARTICLE AND ARTICLES THEREOF

This application claims the benefit of the filing date of U.S. Provisional Application Ser. No. 60/557,037, entitled "Compositions and Methods for Imparting Stain Resistance, Liquid Repellency, and Enhanced Antimicrobial Activity to an Article and Articles Thereof" filed Mar. 26, 2004 the entirety of which is incorporated herein.

FIELD OF THE INVENTION

Described herein are compositions and methods for imparting stain resistance, liquid repellency and enhanced antimicrobial activity to an article. Also described herein are articles treated with the compositions and methods described herein.

BACKGROUND OF THE INVENTION

Materials and articles are subject to stain by certain natural and artificial colorants found in foods and other consumer products. The addition of stain resistant characteristics to articles provides a more desirable end product for the consumer.

One method of imparting stain resistance to fibers containing free amino groups is disclosed in U.S. Pat. No. 4,699,812. U.S. Pat. No. 4,699,812 discloses a process for imparting stain resistance in which a solution of aliphatic sulfonic acid is applied to the fibers, which are then dried.

U.S. Pat. No. 4,592,940 discloses a process for imparting stain resistance to nylon fibers, in which the fibers are treated with the condensation products of formaldehyde and a mixture of diphenolsulfone and phenolsulfonic acid. The fibers are treated by immersing carpet in the boiling treatment solution at a pH of 4.5 or less.

U.S. Pat. No. 4,822,373 discloses a process for treating polyamide materials in which a fibrous polyamide substrate is treated with a combination of (a) a partially sulfonated phenol formaldehyde polymer and (b) polymethacrylic acid, copolymers of methacrylic acid, or combinations of polymethacrylic acid and copolymers of methacrylic acid. The solution is generally applied as an aqueous solution at a pH below about 7.

U.S. Pat. No. 4,940,757 discloses a stain resistant polymeric composition for fibers having polyamide linkages. The composition is prepared by polymerizing a substituted acrylic acid in the presence of a sulfonated aromatic condensation polymer. The composition is applied to the substrate via flood, spray, foam methods, etc.

Additionally, U.S. Pat. No. 3,949,124 discloses a method and composition of imparting soil-repellency and antistatic properties. The reference discloses the pretreatment of a substrate with a material containing the condensation products of formaldehyde and another component chosen from a wide variety and long list, some of which are sulfonated phenol, diaryl sulfone, urea, melamine and dicayndiamide, followed by heat treatment and application of a separate composition containing, as one ingredient, a water-dispersible polyester and amino polymer followed by another heat treatment.

Despite existing methods for imparting stain resistance to an article, there still exists a need for compositions and methods that provide better stain resistance, while at the same time impart other beneficial properties such as liquid repellency and enhanced antimicrobial activity to an article. One approach is to deliver aluminum to the article. Although it is known in the art to treat fibers with aluminum salts, this approach has numerous disadvantages. For example, the aluminum salt can be readily removed from the fiber after washing or prolonged physical contact. This ultimately reduces the durability of the article. Additionally, it is only possible to deliver a limited amount of aluminum salt to the article. Aluminum salts are generally used as coagulants. Therefore, when the aluminum salt is used in combination with a polymer, the aluminum salts will coagulate the polymer, which ultimately reduces the efficiency of delivering the aluminum to the article. Thus, there is a need for compositions and methods for delivering high amounts of aluminum to an article, wherein the aluminum remains on the article for an extended period of time so that the article possesses increased stain resistance, liquid repellency, and antimicrobial activity as well as increased durability. The compositions and methods described herein possess these advantages.

SUMMARY OF THE INVENTION

Described herein are compositions and methods for imparting stain resistance, liquid repellency, and enhanced antimicrobial activity to an article. Also described herein are articles treated with the compositions and methods described herein.

Additional advantages of the compositions, methods, and articles described herein will be set forth in part in the description that follows, and in part will be apparent from the description. The advantages of the compositions, methods, and articles described herein will be realized and attained by means of the elements and combination particularly pointed out in the appended claims. It is to be understood that both the foregoing general description and the following detailed description are exemplary and explanatory only and are not restrictive of the compositions, methods, and articles described herein, as claimed.

DETAILED DESCRIPTION OF THE INVENTION

The compositions, methods, and articles described herein can be understood more readily by reference to the following detailed description. It is also to be understood that the terminology used herein is for the purpose of describing particular aspects only and is not intended to be limiting.

It must be noted that, as used in the specification and the appended claims, the singular forms "a," "an" and "the" include plural referents unless the context clearly dictates otherwise. Thus, for example, reference to "an aromatic compound" includes mixtures of aromatic compounds.

Often ranges are expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

Disclosed are materials and components that can be used for, can be used in conjunction with, can be used in preparation for, or are products of the disclosed compositions and methods. These and other materials are disclosed herein, and it is understood that when combinations, subsets, interactions, groups, etc. of these materials are disclosed that while specific reference of each various individual and collective combinations and permutation of these compounds may not be explicitly disclosed, each is specifically contemplated and described herein. For example, if an aluminum polymer is disclosed and discussed and a number of different surfactants are discussed, each and every combination and permutation of the aluminum polymer and the surfactants that are possible are specifically contemplated unless specifically indicated to the contrary. Thus, if a class of molecules A, B, and C are disclosed as well as a class of molecules D, E, and F and an example of a combination molecule, A D is disclosed, then even if each is not individually recited, each is individually and collectively contemplated. Thus, in this example, each of the combinations A-B, A-F, B-D, B-E, B-F, C-D, C-B, and C-F are specifically contemplated and should be considered disclosed from disclosure of A, B, and C; D, B, and F; and the example combination A-D. Likewise, any subset or combination of these is also specifically contemplated and disclosed. Thus, for example, the sub-group of A-E, B-F, and C-B are specifically contemplated and should be considered disclosed from disclosure of A, B, and C; D, B, and F; and the example combination A-D. This concept applies to all aspects of this disclosure including, but not limited to, steps in methods of making and using the disclosed compositions. Thus, if there are a variety of additional steps that can be performed it is understood that each of these additional steps can be performed with any specific embodiment or combination of embodiments of the disclosed methods, and that each such combination is specifically contemplated and should be considered disclosed.

Throughout this application, where publications are referenced, the disclosures of these publications in their entireties are hereby incorporated by reference into this application in order to more fully describe the state of the art to which this invention pertains.

Any of the compositions described herein can be used to impart stain resistance, liquid repellency, and/or enhanced antimicrobial activity. In one aspect, the composition includes a solvent, a surfactant, and an aluminum polymer, wherein the aluminum polymer does not contain a fluoro group.

In one aspect, the solvent can be water, an organic solvent, or a combination thereof. Examples of organic solvents include, but are not limited to, glycols, ethers, and petroleum compounds. The amount of solvent present in the composition will vary depending upon the article to be treated as well as the particular solvent that is used. In one aspect, the solvent can be from 60% to 98% by weight, 65% to 98% by weight, 70% to 98% by weight, or 75% to 98% by weight of the composition.

The compositions described herein contain one or more surfactants. The term "surfactant" as used herein includes, but is not limited to, dispersants, emulsifiers, detergents, and wetting agents. Any of the surfactants disclosed in U.S. Pat. Nos. 4,648,882 and 5,683,976, which are incorporated by reference in their entireties, can be used herein.

In one aspect, the surfactant can be anionic, cationic, or neutral. In one aspect, the anionic surfactant can be a sulfate or sulfonate, although other types, such as soaps, long-chain N-acyl sarcosinates, salts of fatty acid cyanamides or salts of ether carboxylic acids, of the type obtainable from long-chain alkyl or alkylphenyl poly 20 ethylene glycol ethers and chloroacetic acid, can also be used. The anionic surfactant can be used in the form of the alkali metal or alkali earth metal salt.

In one aspect, surfactants of the sulfate type are sulfuric acid monoesters of long-chain primary alcohols of natural and synthetic origin containing from 10 to 20 carbon atoms, i.e. of fatty alcohols such as, for example, coconut oil fatty alcohols, tallow fatty alcohols, oleyl alcohol, or of $C_{10}$-$C_{20}$ oxoalcohols and those of secondary alcohols having chain lengths in the same range. Sulfated fatty acid alkanolamides and sulfated fatty acid monoglycerides are also suitable.

In another aspect, surfactants of the sulfonate type can be a salt of sulfosuccinic acid monoesters and diesters containing from 6 to 22 carbon atoms in the alcohol portions, alkylbenzene sulfonates containing $C_9$-$C_{15}$ alkyl groups and lower alkyl esters of α-sulfofatty acids, for example the α-sulfonated methyl or ethylesters of hydrogenated coconut oil fatty acids, hydrogenated palm kernel oil fatty acids or hydrogenated tallow fatty acids. Other suitable surfactants of the sulfonate type are the alkane sulfonates obtainable from $C_{12}$-$C_{18}$ alkanes by sulfochiorination or sulfoxidation and subsequent hydrolysis or neutralization or by addition of bisulfites onto $C_{12}$-$C_{18}$ olefins and also the olefin sulfonates i.e. mixtures of alkene and hydroxyalkane sulfonates and disulfonates, obtained for example from long-chain monoolefins containing a terminal or internal double bond by sulfonation with gaseous sulfur trioxide and subsequent alkaline or acidic hydrolysis of the sulfonation products.

In one aspect, the surfactant can be diphenyl oxide disulfonate disodium salt such as CALFAX® TG-45 manufactured by Pilot Corp. or a disodium alpha olefin sulfonate such as CALSOFT® AOS-40 manufactured by Pilot Corp., wherein the disodium alpha olefin sulfonate contains a mixture of $C_{12}$ to $C_{16}$ sulfonates.

The amount of surfactant present in the composition will vary depending upon the article to be treated as well as the particular surfactant that is used. In one aspect, the surfactant can be from 0.2% to 10% by weight, 0.2% to 9% by weight, 0.2% to 8% by weight, 0.2% to 6% by weight, 0.2% to 5% by weight, 0.2% to 4%, or 0.2% to 3% by weight of the composition.

The compositions described herein also contain an aluminum polymer. The term "aluminum polymer" is defined as any polymeric material that contains at least one aluminum atom. The aluminum atom in the aluminum polymer can be covalently or ionically attached to the polymeric material. In one aspect, the polymeric material can contain at least one group that can interact with the aluminum atom either by a Lewis acid/base interaction or a Bronsted acid/base interaction. Examples of polymeric materials that can be used to produce the aluminum polymer include, but are not limited to, polyesters, polyols, polyamines, polyamides, polyurethanes, polycarbonates, polyacrylates, polymethacrylates, or a melamine-based resin. The polymeric material used to produce the aluminum polymer does not have any fluoro atoms or groups containing fluoro atoms covalently attached to the polymeric material. The molecular weight of the polymeric material can vary depending upon the polymer selected and its application.

The aluminum polymers can be prepared using techniques known in the art. For example, polyacrylic acid can be treated with a base to deprotonate at least one carboxylic acid group followed by the addition of an aluminum compound such as, for example, at-i aluminum salt to produce aluminum polyacrylate. In one aspect, the aluminum polymer can be aluminum polyacrylate, aluminum polymethacrylate, or a combination thereof. For example, aluminum polyacrylate and aluminum polymethacrylate provided by Aldrich Chemical Company can be used herein. In one aspect, aluminum polyacrylate and aluminum polymethacrylate can be prepared from the polymerization of aluminum acrylate and aluminum methacrylate, respectively, using techniques known in the art.

The aluminum polymer can be used in various forms including, but not limited to, a solid (e.g., a powder) or a dispersion (e.g., in water or organic solvent). The amount of aluminum polymer present in the composition will vary depending upon the article to be treated as well as the particular aluminum polymer that is used. In one aspect, the aluminum polymer can be from 1% to 30% by weight, 5% to 30% by weight, 10% to 30% by weight, 20% to 30% by weight, or 20% to 25% by weight of the composition.

In one aspect, the surfactant can be from 0.2% to 10% by weight of the composition, the aluminum polymer can be from 1% to 30% by weight of the composition, and the solvent can be from 70% to 98% by weight of the composition, wherein the sum of the amounts of surfactant, aluminum polymer, and solvent is less than or equal to 100%. In the case when the amount of the solvent, surfactant, and aluminum polymer is less than 100% by weight, the composition can contain one or more other components described below.

In one aspect, any of the compositions described herein can optionally include (1) an anionically modified phenol formaldehyde polymer comprising a phenol moiety and a formaldehyde moiety, (2) a naphthalene condensate, (3) a lignin sulfonate, (4) a phenol sulfonate derivative, or a mixture thereof. Any of the anionically modified phenol formaldehyde polymers, naphthalene condensates, lignin sulfonates, and phenol sulfonate derivatives disclosed in U.S. Pat. No. 6,387,448 B1, which is incorporated by reference in its entirety, can be used herein.

The anionically modified phenol formaldehyde polymers appropriate for use in the compositions described herein include, but are not limited to, condensation products of aldehydes with phenyl bearing molecules and anionically modifying agents. The phenol formaldehyde polymer can be anionically modified by methods including, but not limited to, sulfonation, phosphonation and acylation. When sulfonation is preferred, it is accomplished by using sulfonic acid. In one aspect, the polymer contains phenylsulfonic acid residues. In other aspects, the polymer can be a condensation product of naphtholsulfonic acid and an aldehyde, an anionically modified hydroxyaromatic formaldehyde condensate, the condensation product of anionically modified dihydroxydiphenylsulfone or the condensation product of naphtholsulfonic acid or the derivatives of any of these polymers.

Examples of other suitable anionically modified phenol formaldehyde polymers or compounded materials based on phenol formaldehyde polymers include, but are not limited to, DU PONT SR-500 (Du Pont), FX 369, 668, 661 (3M), INTRATEX N (Crompton and Knowles), ERIONYL PA (Ciba-Geigy), NYLOFIXAN P and PM (formerly Sandoz, now Claraint), MESITOL NBS (formerly Mobay Chemical Corp., now Dystar, Inc.), ARROWSHIELD® GSR AND ARROWSHIELD® 2713 (Arrow Engineering), etc. In an alternative aspect, lignin sulfonates can be used in place of the anionically modified phenol formaldehdye polymer. In yet another aspect, naphthalene condensates can be used in place of the anionically modified phenol formaldehyde polymer. In yet another aspect, phenol sulphonate derivatives can be used in place of the anionically modified phenol formaldehyde polymer.

Compounds suitable for use as the anionically modified phenol formaldehyde polymer are disclosed in U.S. Pat. Nos. 4,592,940; 4,839,212; 4,822,373; 4,940,757; and 4,937,123, which are herein incorporated by this reference in their entirety and for the teachings of suitable anionically modified phenol formaldehyde polymers.

In another aspect, any of the compositions described herein can optionally include one or more binders. A "binder" as used herein is any material that facilitates the bonding of one or more components present in the composition to the article. In one aspect, the binder can be a polymeric resin. The binders disclosed in U.S. Pat. Nos. 4,775,588; 5,147,722; and 5,539,015, which are incorporated by reference in their entireties, can be used herein. In one aspect, the binder can be a polyolefin (e.g., polyethylene, polypropylene, polybutene-1, and poly-4-methylpentene-1); a polyvinyl (e.g., polyvinyl chloride, polyvinyl fluoride, and polyvinylidene chloride); a polyurethane; a polyacrylate (e.g., polyacrylate or polymethacrylate); a polyvinyl ester (e.g., polyvinyl acetate, polyvinyl proprionate, and polyvinyl pyrrolidone); a polyester; a polyvinyl ether; a polyvinyl sulfate; a polyvinyl phosphate; a polyvinyl amine; a polyoxidiazole; a polytriazol; a polycarbodiimide; a copolymer or block interpolymer (e.g., ethylene-vinyl acetate copolymer); a polysulfone; a polycarbonate; a polyether (e.g., polyethylene oxide, polymethylene oxide, and polypropylene oxide); a polyarylene oxide; a polyester (e.g., a polyarylate such as polyethylene terephthalate); or a polyimide.

The amount of binder present in the composition will vary depending upon the article to be treated as well as the particular binder that is used. In one aspect, the binder can be from 0.1% to 50% by weight, 0.1% to 40% by weight, 0.1% to 30% by weight, 0.1% to 20% by weight, 0.1% to 10% by weight, or 0.1% to 5% by weight of the composition.

In another aspect, any of the compositions described herein can optionally contain a wax-modified polymer. The term "wax-modified polymer" is defined herein as a compound composed of a wax component and a polymer component, wherein the wax component and polymer component are covalently attached to one another. Not wishing to be bound by theory, the wax-modified polymer facilitates the polyester in binding the zeolite to an article. In one aspect, the wax component contains a group that can react with an amino group or a hydroxyl group. In one aspect, the wax component can be paraffin. In one aspect, any of the waxes disclosed in U.S. Pat. No. 4,566,980, which is incorporated by reference in its entirety, can be used herein as the wax component. In one aspect, the wax includes one or more of a natural wax or a synthetic wax. In one aspect, the natural wax includes animal wax (e.g., beeswax, lanolin, shellax wax, Chinese insect wax) or a mineral wax (e.g., fossil or earth waxes such as ozocerite, ceresin, or montan, or petroleum waxes such as paraffin or microcrystalline wax). In another aspect, the synthetic wax can be a polyalkylene such as an ethylenic polymer and polyol ether-esters such as Carbowax and sorbitol, a chlorinated naphthalene such as Halowax, or a hydrocarbon produced from a Fischer Tropsch reaction.

In one aspect, the polymer component of the wax-modified polymer contains an amino group or a hydroxyl group. In one aspect, the polymer can be a melamine resin, a phenolic acid resin, a urea resin or a combination thereof. Any of the melamine resins and derivatives thereof disclosed in U.S. Pat. Nos. 5,952,447; 6,040,044, and 6,534,150 B1, which are incorporated by reference in their entireties, can be used herein. In one aspect, two or more different polymers can be used to prepare the wax-modified polymer. In one aspect, the wax-modified polymer is CEROL-EX manufactured by Clariant, which is the reaction product between paraffin and melamine resin.

The amount of wax-modified polymer present in the composition will vary depending upon the article to be treated as well as the particular wax-modified polymer that is used. In one aspect, the wax-modified polymer can be from 1% to 50% by weight, 1% to 40% by weight, 1% to 30% by weight, 1% to 20% by weight, 5% to 15% by weight, or 10% by weight. In another aspect, the wax-modified polymer can be used in dry form or in the form of an emulsion or dispersion.

In another aspect, any of the compositions described herein can optionally include one or more metal oxides. In one aspect, the metal oxide can be a transition metal oxide. In another aspect, the metal oxide is an oxide of silicon, aluminum, titanium, zirconium, zinc, or a combination thereof. The amount of metal oxide present in the composition will vary depending upon the article to be treated and the particular metal oxide.

In one aspect, the metal oxide can be zeolite. In general, zeolites are aluminosilicate materials. Any of the zeolites disclosed in U.S. Pat. Nos. 4,304,675; 4,437,429; 4,793,833; and 6,284,232 B1, which are incorporated by reference in their entireties, can be used herein. In one aspect, the zeolite includes a mixture of $SiO_2$, $Al_2O_3$ and $Na_2O$. In one aspect, when the zeolite includes a mixture of $SiO_2$, $Al_2O_3$ and $Na_2O$, the amount of $SiO_2$ present is from 70% to 99% by weight, 80% to 99% by weight, 90% to 99%, 90% to 95% by weight, or 92% to 95% by weight of the zeolite; the amount of $Al_2O_3$ in the zeolite is from 1% to 20% by weight, 2% to 10% by weight, 3% to 7% by weight, or from 4% to 6% by weight of the zeolite; and the amount of $Na_2O$ in the zeolite is from 0.5% to 20% by weight, 1% to 10% by weight, 1% to 8% by weight, 1% to 6% by weight, 1% to 4% by weight, or from 1% to 2% by weight of the zeolite. In one aspect, the zeolite can be mordenite. In another aspect, mordenite manufactured by Chemie Uetikon and P.Q. Corp. can be used herein.

In another aspect, any of the compositions described herein can optionally include one or more fluorocompounds. In one aspect, the fluorocompound can include, but is not limited to, fluorochemical urethanes, ureas, esters, ethers, alcohols, epoxides, allophanates, amides, amines (and salts thereof), acids (and salts thereof), carbodiimides, guanidines, oxazolidinones, isocyanurates, and biurets. Blends of these compounds are also considered useful. In another aspect, the fluorocompound can be a fluoropolymer. Examples of fluoropolymers useful herein include, but are not limited to, fluorinated acrylate and substituted acrylate homopolymers or copolymers containing fluorinated acrylate monomers interpolymerized with monomers free of non-vinylic fluorine such as methyl methacrylate, butyl acrylate, acrylate and methacrylate esters of oxyalkylene and polyoxyalkylene polyol oligomers (e.g., oxyethylene glycol dimethacrylate, polyoxyethylene glycol dimethacrylate, methoxy acrylate, and polyoxyethylene acrylate), glycidyl methacrylate, ethylene, butadiene, styrene, isoprene, chloroprene, vinyl acetate, vinyl chloride, vinylidene chloride, vinylidene fluoride, acrylonitrile, vinyl chloroacetate, vinylpyridine, vinyl alkyl ethers, vinyl alkyl ketones, acrylic acid, methacrylic acid, 2-hydroxyethylacrylate, N-methylolacrylamide, 2-(N,N,N-trimethylammonium)ethyl methacrylate, and 2-acrylamido-2-methylpropanesulfonic acid (AMPS). In another aspect, the fluoropolymer can be a urethane backbone fluoropolymer, wherein the fluoropolymer is cationic, anionic, or neutral. An example of an anionic urethane backbone fluoropolymer useful herein is ZONYL N-i 19 manufactured by Du Pont or ARROWTEX Fl 0-X manufactured by Arrow Engineering.

In addition to the components discussed above, the compositions described herein can optionally include other ingredients including, but not limited to, anionic leveling agents, cross-linking agents, optical brighteners, chelating agents, and inorganic/organic salts, foaming agents, ultra-violet absorption, enhanced lightfastness, flame retardants, odor elimination products, fillers and carriers, antisoiling or resoiling inhibitors, preservatives, thickeners, etc.

In one aspect, the composition consists essentially of the solvent, the surfactant, and the aluminum polymer. In this aspect, it is contemplated that the composition contains small amounts of other components where these components do not affect one way or the other the properties of the composition.

In one aspect, the composition includes water as the solvent, disodium alpha olefin sulfonate or diphenyl oxide disulfonate disodium salt as the surfactant, and aluminum polyacrylate or aluminum polymethacrylate as the aluminum polymer.

Any of the compositions described herein can be produced by admixing the solvent, the surfactant, the aluminum polymer, and one or more optional ingredients discussed above in any order. The term "admixing" is defined as the mixing of two or more components together so that there is no chemical reaction or physical interaction. The term "admixing" also includes the chemical reaction or physical interaction between any of the components described herein upon mixing to produce the composition. For example, depending upon the selection of the aluminum polymer and surfactant, it is possible that these components possess groups that can react with one another to produce a new chemical species.

The components used to produce the compositions described herein can be admixed using techniques described in the art. For example, mixers such as paddle mixers, drum mixers, auger mixers and the like can be used. In one aspect, finely divided solid constituents are initially introduced into the mixer in which they are then sprayed while mixing with the liquid constituents. In another aspect, either the solid components and/or the liquid components are premixed prior to their introduction into the mixer. In one aspect, after thorough blending of the finely divided solid constituents with the liquid constituents, a smooth flowable powder or liquid is produced.

In one aspect, any of the compositions described herein can be applied to an article using techniques known in the art. The method for contacting the article with the composition will vary depending upon the article and the form of the composition. In one aspect, the compositions described herein can be in the form of an aqueous medium or a dispersion, such as a foam. Alternatively, the compositions described herein can be dissolved or dispersed in an organic solvent such as, for example, a glycol or polyether, or an aqueous organic solvent. In this aspect, the composition can be applied to the article by spray application. In another aspect, other methods such as, for example, Beck application, Continuous Liquid and Foam application, Flood, Flex Nip and Pad applications can be used to contact the article with the composition.

In another aspect, when the contacting step involves topical coating, the coating step can be performed by spray, foam, kiss or liquid injection methods and various methods thereof followed by drying in a hot air or radiant heat oven at 160 to 320° F. for a time sufficient to dry the article. In one aspect, a spray application can be applied in a liquid medium (water and chemical treatment) with a wet pickup of 5% to about 200% followed by drying. In another aspect, a foam application can be applied in a liquid medium (water and chemical treatment) with a wet pickup of 5% to about 200%. In this aspect, the foam can be applied by a direct puddle application with a press roll, an injection manifold and/or a sub-surface extraction device. Subsequent drying in a hot air or radiant heat oven at 160 to 320° F. for a time sufficient to dry the article should follow.

The prevailing plant conditions will also affect the amount of composition to be applied to the article to achieve the desired odor resistance. The composition of the article will also influence the amount of composition to be applied.

Application conditions such as pH, temperature, steam and drying time can vary. In one aspect, the pH range for the compositions described herein is from about 1.0 to about 11.0. Still further, the pH of the compositions of the present invention can be from 1.0, 1.5, 2.0, 2.5, 3.0, 3.5, 4.0, 4.5, 5.0, 5.5, 6.0, 6.5, 7.0, 7.5, 8.0, 8.5, 9.0, 9.5, 5 10.0, 10.5 or 11.0 where any value can be used as an upper or a lower endpoint, as appropriate. As would be recognized by one of ordinary skill in the art, the amount of pH adjustment needed prior to use of the compositions will depend on the amount of each component in the composition. Further, pH adjustment of the composition prior to use can be by methods known to one of ordinary skill in the art, such as the addition of acid or base, as appropriate.

The temperature at which the article is contacted by the compositions described herein range from ambient to temperatures up to 100° C. at atmospheric pressure and above 100° C. under pressure conditions (closed atmosphere). Still further, the temperature of application can be from 25, 35, 45, 55, 65, 75, 85 or 100° C., where any value can form an upper or a lower end point, as appropriate.

Where production procedures warrant, steam can aid in the efficacy of the compositions herein when applied by, but not limited to Beck, Continuous liquid, Flood, Flex Nip and Pad applications. The steam time can vary from about 15 seconds to about 10 minutes, or from about 2 minutes to about 8 minutes. Still further, the application time can be from about 15 seconds or 1, 2, 3, 4, 5, 6, 7, 8, 9 or 10 minutes, where any value can form an upper or a lower end point, as appropriate. In certain applications, but not limited to Spray Application and Foam Application, drying with forced heat can aid in the fixing of the composition to the article. In one aspect, the coated article can be dried with forced air. In another aspect, the coated article can be dried with microwave heat. The drying time is generally dependent upon varying conditions predicated by moisture content, range speed, type construction, the weight of the substrate, etc. The drying time can vary from 30 seconds to 15 minutes. Still further, the drying time can be from 15 seconds or 1, 3, 5, 7, 9, 10, 12, or 15 minutes, where any value can be used as an upper or lower endpoint, as appropriate.

In one aspect, the weight ratio of the composition can vary between 0.5% to 600% of wet pick up where such amount is based on the weight of the article and the composition that is used. The weight ratio will vary dependent on the manner of application. In other aspects, the owf ("on weight fiber") amount of the composition that can be applied to the article is from 0.05, 0.1, 0.2, 0.5, 1, 2, 3, 4, 5, 6, 7, 8, 9, 10, 30, 50, 70, 100, 120, 150, 200, 250, 300, 350, 400, 450, 500, 550 or 600% as measured by weight of the article, where any value can be used as an upper or lower endpoint, as appropriate. In one aspect, the owf amount of the composition that is applied to the article is from 0.5% to 5.0%.

In one aspect, once the article has been contacted with the composition, the article can be further treated to remove any composition that is not bound to the article.

Also contemplated herein are articles treated with any of the compositions described herein. In one aspect, the article can be composed of any material that can receive and that will adhere to the composition where stain resistance, liquid repellency, and/or enhanced antimicrobial activity are desirable. Examples of articles include, but are not limited to, bedding (e.g., blankets, sheets, pillowcases, litton or comforter covers, comforter wadding), clothes (e.g., suits, uniforms, shirts, blouses, trousers, skirts, sweaters, socks, panty hoses, shoe linings, shoe sole inserts), curtains, carpet, diapers, incontinent pads, surgical sponges and dressings, surgical pads, or catamenial devices such as sanitary napkins, shields, liners, or tampons.

In one aspect, the article is composed of natural and/or synthetic fibers. In one aspect, the synthetic fiber includes, but is not limited to, polyamide fibers, synthetic fibers containing free amino groups, and derivatives thereof such as nylon covered with polypropylene. Fibers containing free amino groups can be obtained by a variety of methods, including, but not limited to, the condensation reaction of hexamethylenediamine with adipic acid, hexamethylenediamine with sebacic acid, x aminodecanoic acid, caprolactam and dodecylcaprolactam. Fibers formed from polyaryl amides, including type 6 and type 6,6 nylons, can be treated by the compositions and methods described herein. Examples of natural fibers include, but are not limited to, cotton, wool, and flax. Semi-synthetic fibers such as rayon can also be contacted with any of the compositions described herein.

The fibers treated with the compositions and methods described herein can be twisted, woven, tufted and sewn into various forms of textile materials including, but not limited to, rugs, carpets, and yarns. The fibers can be treated and then formed into the various forms of textile mat or the formed textile can be treated.

In one aspect, the article can contain one or more fluorocompounds prior to treatment with any of the compositions described herein. In this aspect, these articles are referred to herein as fluorinated articles, wherein the article has at least one fluoro group. In one aspect, when the article is a fiber, the fluorocompound can be extruded with the material used to make the fiber so that the resultant fiber contains the fluorocompound incorporated throughout the fiber. Any of the fluorocompounds described above can be used in this aspect. The number or amount of fluoro groups present in the fluorinated article will vary depending upon the article and the fluorocompound selected. In one aspect, the amount of fluoro groups present in the fluorinated article can be from 20 ppm to 5,000 ppm, 50 ppm to 5,000 ppm, 100 ppm to 5,000 ppm, 150 ppm to 5,000 ppm, 200 ppm to 5,000 ppm, 200 ppm to 4,000 ppm, 200 ppm to 3,000 ppm, 200 ppm to 2,000 ppm, or 200 ppm to 1,000 ppm.

In one aspect, the compositions described herein can impart stain resistance to an article. The term "stain resistance" is defined herein as the ability of an article to resist staining by any means. For example, the articles coated with the compositions described herein can be resistant to stains formed by any material or compound that contains a colorant. Examples of colorants include, but are not limited to, cationic dyes present in, for example, fruit juices, which can react with the article and permanently color or stain the article. The term "stain resistance" also includes the ability of the compositions described herein to help maintain the color of the coated article over time. The term "stain resistance" also includes the term soil resistance. The term "soil resistance" is defined herein as the ability of an article to resist soiling by a substance. Substances that can soil an article include, but are not limited to, solid particles such as, for example, fly ash, grass, clay, or other inorganic particulates; liquids such as, for example, oils and greases; mixtures of solids and liquids such as, for example, soot that contain particles mixed with oily components; and biological matter such as skin cells and sebum. Not wishing to be bound by theory, it is believed that the liquid repellent properties of the compositions described herein is one reason why the compositions described herein impart soil resistant properties to an article. Thus, the composition described herein prevent or reduce the ability of a soiling substance to stick or adhere to the surface of an article.

Stain resistance can be quantitatively determined using techniques known in the art including, but not limited to, the AATCC Test Method 175-1993. Many production facilities, however, have modified this test to meet their own specific production requirements. The stain resistance can vary according to the end use of the article. In one aspect, the article has a stain resistance of at least 4, at least 6, at least 7, or 8 or higher based on the AATCC Test Method.

In another aspect, the compositions described herein can impart liquid repellency to an article. The term "liquid repellency" is defined herein as the ability of an article to avoid penetration of a liquid into the article. Examples of liquids include water, an organic solvent, or a combination thereof. Any of the methods disclosed in U.S. Pat. Nos. 5,948,480 and 6,613,862, which are incorporated by reference for their teachings for measuring water repellency, can be used herein. Not wishing to be bound by theory, it is believed that the aluminum present in the aluminum polymer is responsible for imparting the liquid repellency to the article.

In another aspect, the compositions described herein can enhance the activity of an antimicrobial agent. The term "enhanced" with respect to the activity of the antimicrobial agent is defined herein as the improved or increased activity of the antimicrobial agent when used in combination with the compositions described herein when compared to the activity of the antimicrobial agent when used in the absence of the compositions described herein. The term "antimicrobial" is used in its general sense to refer to the property of the described compound, product, composition or article to prevent or reduce the growth, spread, formation or other livelihood of organisms such as bacteria, viruses, protozoa, molds, or other organisms likely to cause spoilage or infection.

In one aspect, the antimicrobial agent(s) can be part of the compositions described herein prior to contacting the article. In another aspect, the article can be contacted with the antimicrobial agent followed by treatment with the compositions described herein. In another aspect, the article can be contacted with the compositions described herein followed by treatment with the antimicrobial agent. The amount of antimicrobial agent that can be used will vary depending upon the article and antimicrobial agent selected. Antimicrobial agents useful herein are well known to one of ordinary skill in the art. Examples of antimicrobial agents useful in combination with the compositions described herein include organosilanes. Any of the organosilanes disclosed in U.S. Pat. Nos. 6,221,944; 5,959,014; 5,411,585; 5,064,613; 5,145,592; 3,560,385; 3,794,736; 3,814,739, and the publication entitled "A Guide to DC Silane Coupling Agent" (Dow Corning, 1990) are useful as antimicrobial agents, the contents of which are hereby incorporated by this reference.

It is contemplated that any of the compositions described herein can possess any combination of the properties described above. Thus, depending upon the composition selected, the article treated with the composition can possess stain resistant properties, liquid repellent properties, enhanced antimicrobial activity, or a combination thereof.

It will be apparent to those skilled in the art that various modifications and variations can be made without departing from the scope or spirit of the compositions, methods, and articles described herein. Other aspects will be apparent to those skilled in the art from consideration of the specification and practice of the aspects disclosed herein. It is intended that the specification and examples be considered as exemplary only.

What is claimed is:

1. A composition consisting of a solvent, a surfactant, and an aluminum polymer, wherein the aluminum polymer does not contain a fluoro group, the aluminum polymer is an aluminum polyamide, an aluminum polycarbonate, an aluminum polyacrylate, an aluminum polymethacrylate, or a mixture thereof, the composition does not include an antimicrobial agent, a polyurethane and a fluorocarbon, and wherein the composition is a solution or liquid dispersion.

2. The composition of claim 1, wherein the solvent is water, an organic solvent, or a mixture thereof.

3. The composition of claim 1, wherein the amount of solvent in the range of 60% to 98% by weight of the composition.

4. The composition of claim 1, wherein the amount of aluminum polymer is in the range of 10% to 30% by weight of the composition.

5. The composition of claim 1, wherein the surfactant is a neutral surfactant or cationic surfactant.

6. The composition of claim 1, wherein the surfactant is an anionic surfactant.

7. The composition of claim 1, wherein the surfactant is a sulfonated surfactant.

8. The composition of claim 1, wherein the surfactant is disodium alpha olefin sulfonate or diphenyl oxide disulfonate disodium salt.

9. The composition of claim 1, wherein the amount of surfactant is in the range of 0.2% to 10% by weight of the composition.

10. The composition of claim 1, wherein the amount of surfactant is in the range of 0.2% to 10% by weight of the composition, the amount of aluminum polymer is in the range of 10% to 30% by weight of the composition, and the amount of solvent is in the range of 70% to 98% by weight of the composition, wherein the sum of the amounts of surfactant, aluminum polymer, and solvent is less than or equal to 100%.

11. The composition of claim 1, wherein the solvent is water, the surfactant is disodium alpha olefin sulfonate or diphenyl oxide disulfonate disodium salt, and the aluminum polymer is aluminum polyacrylate or aluminum polymethacrylate.

12. The composition of claim 1, wherein the composition is applied to an article by Beck, Continuous liquid, Flood, Flex Nip, Pad, spray, foam, kiss, or liquid injection methods.

13. The composition of claim 1, wherein the amount of aluminum polymer is in the range of 20% to 30% by weight of the composition.

14. The composition of claim 1, wherein the amount of aluminum polymer is in the range of 20% to 25% by weight of the composition.

15. A composition consisting of a solvent, a binder, a surfactant, and an aluminum polymer, wherein the aluminum polymer does not contain a fluoro group, the aluminum polymer is an aluminum polyamide, an aluminum polycarbonate, an aluminum polyacrylate, an aluminum polymethacrylate, or a mixture thereof, the composition does not include an antimicrobial agent, a polyurethane and a fluorocarbon, and wherein the composition is a solution or liquid dispersion.

16. A composition consisting of a solvent, an anionically modified phenol formaldehyde polymer, a surfactant, and an aluminum polymer, wherein the aluminum polymer does not contain a fluoro group, the aluminum polymer is an aluminum polyamide, an aluminum polycarbonate, an aluminum polyacrylate, an aluminum polymethacrylate, or a mixture thereof, the composition does not include an antimicrobial agent, a polyurethane and a fluorocarbon, and wherein the composition is a solution or liquid dispersion.

17. A method for imparting stain resistance to an article, comprising contacting the article with the composition of claim 1.

18. A method for imparting liquid repellency to an article, comprising contacting the article with the composition of claim 1.

19. A method for making an article comprising contacting the article with the composition of claim 1.

* * * * *